US006390113B1

(12) United States Patent
Reif

(10) Patent No.: US 6,390,113 B1
(45) Date of Patent: May 21, 2002

(54) PROCESS FOR SETTING INTO OSCILLATION AN ELECTROMAGNETIC ACTUATOR

(75) Inventor: Konrad Reif, Ottobrunn (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/709,333

(22) Filed: Nov. 13, 2000

(30) Foreign Application Priority Data

Nov. 12, 1999 (DE) ..... 199 54 416

(51) Int. Cl.[7] ..... F16K 31/02
(52) U.S. Cl. ..... 137/1; 251/129.05; 251/129.1
(58) Field of Search ..... 251/129.05, 129.09, 251/129.1; 137/1

(56) References Cited

U.S. PATENT DOCUMENTS 4,612,845 A * 9/1986 Burkel et al. ..... 137/1 X
5,009,389 A * 4/1991 Kawamura ..... 251/129.1
6,005,763 A * 12/1999 North ..... 361/154

FOREIGN PATENT DOCUMENTS

DE 3307070 9/1984
DE 195 44 207 6/1997
DE 196 47 215 7/1997
DE 197 23 931 12/1998
DE 197 39 840 3/1999
EP 0118591 9/1984

OTHER PUBLICATIONS

Copy of the search report.

* cited by examiner

*Primary Examiner*—Kevin Lee
(74) *Attorney, Agent, or Firm*—Crowell & Moring LLP

(57) ABSTRACT

A process for setting into oscillation an electromagnetic actuator, which actuates a switching element, in particular an internal combustion engine lift valve, and in which process an armature, which acts on the switching element, is oscillated between two electromagnet coils against the force of at least one reset spring by an alternating flow around the electromagnet coils so that the switching element with the armature and the reset springs represents an oscillatory spring-mass system, and wherein, starting from the quiescent state of the system, where the armature is held by the reset springs essentially in the center between these magnet coils, the electromagnet coils are excited alternatingly by driving with an electric alternating voltage of a specific frequency to set into oscillation this spring-mass system in the form of a constantly sinusoidal voltage curve or in the form of a correspondingly variable pulse width-modulated voltage curve.

10 Claims, 2 Drawing Sheets

PROCESS FOR SETTING INTO OSCILLATION AN ELECTROMAGNETIC ACTUATOR

This application claims the priority of 199 54 416.6, filed Dec. 11, 1999, in Germany, the disclosure of which is expressly incorporated by reference herein,

BACKGROUND AND SUMMARY OF THE DISCLOSURE

The invention relates to a process for setting into oscillation an electromagnetic actuator, which actuates a switching element, in particular an internal combustion engine lift valve, and in which process an armature, which acts on the switching element, oscillates between two electromagnet coils against the force of at least one reset spring by means of alternating flow around the electromagnet coils. The switching element with the armature and the reset springs represents an oscillatory spring-mass system. Starting from the quiescent state of the system, where the armature is held by the reset springs essentially in the center between these magnet coils, in order to set into oscillation the spring-mass system, the electromagnet coils are excited alternatingly by driving with an electric alternating voltage of a specific frequency. For the technical background reference is made not only to European Patent EP 0 118 591 B1 but also to German Patent DE 33 07 070 C2.

A preferred application for an electromagnetic actuator is the electromagnetically actuated valve drive of internal combustion engines. That is, the gas exchange lift valves of a reciprocating piston internal combustion engine are actuated in the desired manner by such actuators, i.e. oscillatory opening and closing. In such an electromechanical valve drive, the lift valves are moved individually or in groups by means of electromechanical actuating members, referred to as actuators, where the time for opening and closing each lift valve can be chosen virtually arbitrarily. Thus, the valve control times of the internal combustion engine can be optimally adjusted to the current operating state (this is defined by speed and load) as well as to the respective requirements with regard to consumption, torque, emission, comfort and response behavior of a motor vehicle driven by the internal combustion engine.

The essential components of a known actuator for actuating the lift valves of an internal combustion engine are an armature and two electromagnets for holding the armature in the "lift valve open" or "lift valve closed" position with the related electromagnet coils, and furthermore reset springs for moving the armature between the "lift valve open" and "lift valve closed" positions. To this end, reference is also made to FIGS. 1*a* and 1*b*, which depicts such an actuator with assigned lift valve in the two possible end positions of the lift valve and the actuator-armature. Between the two shown states or positions of the actuator-lift valve unit the curve of FIG. 1*b* shows the armature stroke z or armature path between the two electromagnet coils is plotted over time t in a simplified drawing.

FIGS. 1*a* and 1*c* depict the closing operation of an internal combustion lift valve, which is marked with the reference numeral 1 and which moves in the direction of its valve seat 30. As usual, a valve closing spring or first reset spring 2*a* engages with this lift valve 1. Furthermore, the actuator, which is marked 4 in its entirety, acts on the shaft of the lift valve 1 - here through interconnection with a (not absolutely necessary) hydraulic valve clearance compensating element 3. The actuator includes in addition to the two electromagnet coils 4*a*, 4*b*, a push rod 4*c*, which acts on the shaft of the lift valve 1 and which carries an armature 4*d*, which can be slid longitudinally so as to oscillate between the electromagnet coils 4*a*, 4*b*. Furthermore, a valve opening spring or second reset spring 2*b* engages with the end of the push rod 4*c* facing away from the shaft of the lift valve 1.

Thus, it involves a vibratory spring-mass system, for which the valve closing spring 2*a* and the valve opening spring 2*b* form a first as well as a second reset spring, and for which consequently the reference numerals 2*a*, 2*b* will also be used. FIG. 1*a* shows the end position of this oscillatory system, in which the lift valve 1 is completely open and the armature 4*d* rests against the bottom electromagnet coil 4*b*. FIG. 1*c* depicts the second end position of the oscillatory system, where the lift valve 1 is completely closed and the armature 4*d* rests against the upper electromagnet coil 4*a*. The armature 4*d* is moved into these two end positions owing to suitable excitation or suppression of the respective magnet coils 4*a*, 4*b*.

In the quiescent state of the system, i.e. when none of the magnet coils 4*a*, 4*b* are excited, the armature 4*d* is located essentially in the center between the two magnet coils 4*a*, 4*b* and is held in this position by the suitably designed reset springs 2*a*, 2*b*. Starting from this quiescent position, the entire spring-mass system must be set into oscillation for a desired operation of this system, i.e. for a desired oscillating actuation of the lift valve 1.

One possible process for setting into oscillation this spring-mass system is described in the German Patent DE 33 07 070 C2, cited in the introductory part of the specification. Here, too, the electromagnetic actuator with the lift valve and with the reset springs is perceived as a mechanical spring-mass system and the two electromagnet coils are driven with periodic voltage pulses. For the frequency of the exciting periodic voltage pulse the natural frequency of the oscillatory spring-mass system is chosen.

Building on this known state of the art, European Patent first document EP 0 118 591 B1, details that, when viewed over a longer period of time, the exciting frequency be chosen higher than the resonance frequency of the system and then allowed to decrease slowly. In so doing, the frequency is supposed to change slowly so that upon reaching the resonance frequency the lift valve is excited for an adequately long period of time so that the armature can oscillate between its two end positions.

One general drawback with this known state of the art is that, owing to the reciprocal interaction between the electromagnetic part of the actuator and the mechanical spring-mass system, the decoupled approach to these two subsystems that has been practiced to date is only partially reflective of the true situation. Namely this past approach does not take into consideration the intense nonlinear electromagnetic properties of the armature. As a consequence the result is usually many unnecessary preoscillation periods or exciting voltage pulses and thus excess power demand of the electromagnetic actuator. This problem is especially blatant in the state of the art according to European Patent EP 0 118 591 B1, since it is precisely the proposed slow change in the exciter frequency that does not account for a fast change in the resonance frequency owing to the nonlinear effects.

It is an object of the present invention to provide a remedy for this described problem.

The solution to this problem according to the present invention is characterized in that, instead of the hitherto customary essentially rectangular curve of the alternating voltage over the time, an essentially sinusoidal or similar alternating voltage is applied to the electromagnet coils and, in particular, either in the form of a constantly sinusoidal voltage curve or in the form of a correspondingly variable pulse width- modulated voltage curve.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1C:
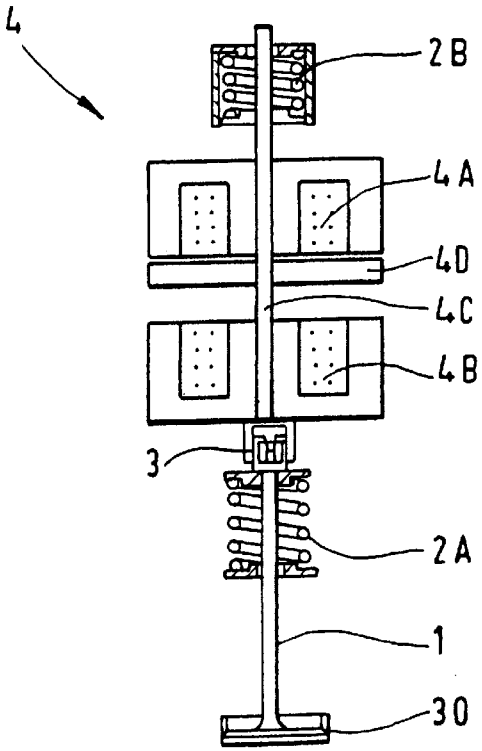
FIGS. 1*a*–1*c* illustrates a closing sequence and an armature path between coils for an internal combustion lift valve.
Figure 1B:
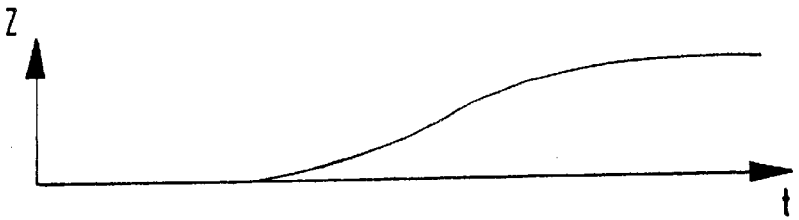
Figure 1A:
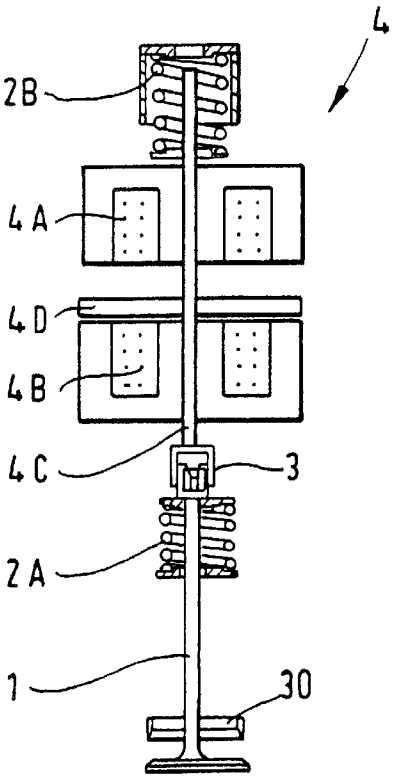
Figure 2A:
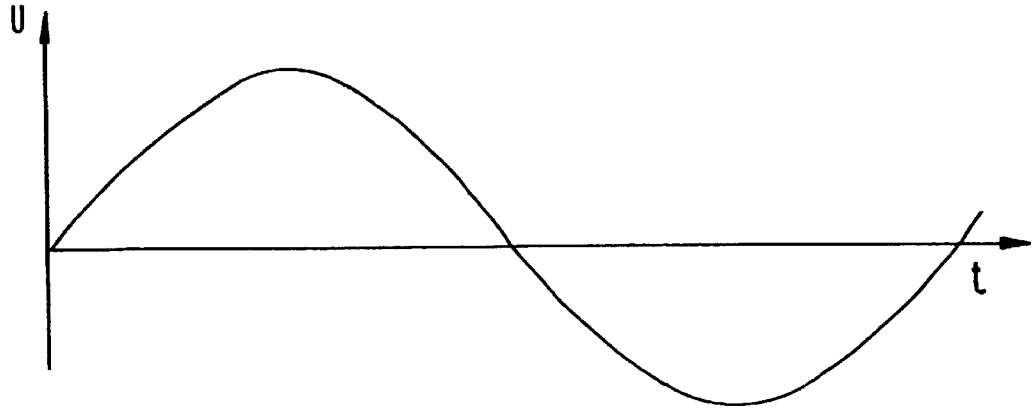
FIGS. 2*a*–2*b* illustrates examples of applied alternative voltage according the present invention.
Figure 2B:
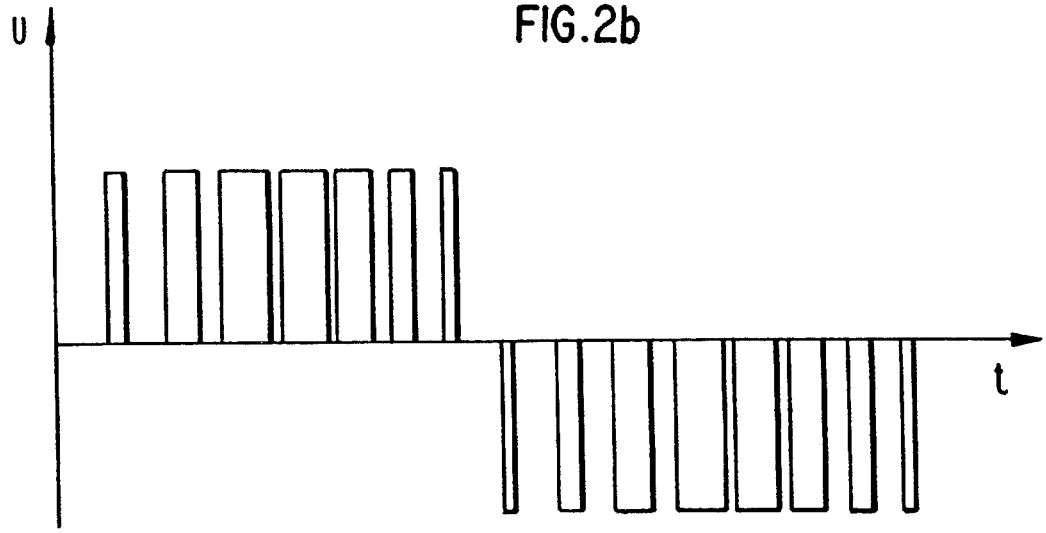
Figure 3:
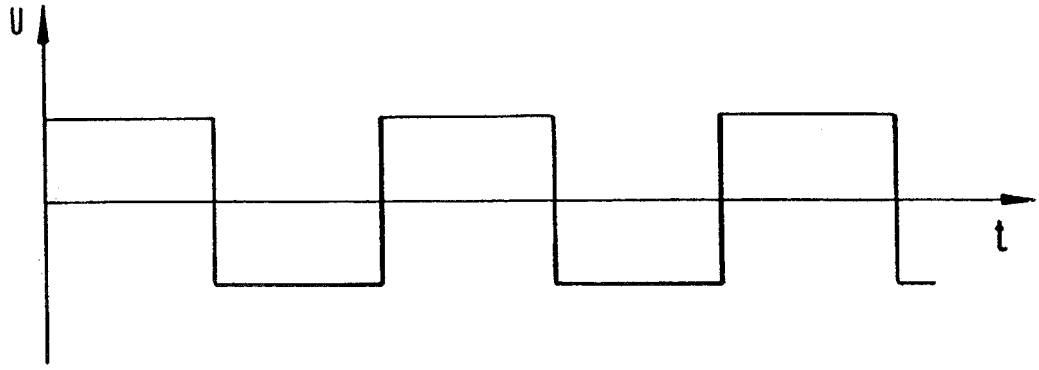
FIG. 3 illustrates application of a rectangular voltage in the prior art.

According to the invention, the voltage curve of the exciting alternating voltage, i.e. applied alternatingly with a specific frequency to the two electromagnet coils, is modified with respect to the state of the art or made variable, since in this manner other factors of influence can be considered. In the known state of the art namely only an essentially rectangular curve of the applied alternating voltage U over the time t was realized to date, as illustrated in FIG. 3 as an example. In contrast, the present invention proposes an essentially sinusoidal curve or a similar curve of the applied alternating voltage U over the time t, as illustrated in FIG. 2*a* as an example. In so doing, it can be a constantly sinusoidal voltage curve (as in FIG. 2*a*), but as an alternative it can also be a correspondingly pulse width-modulated, clocked voltage curve, as depicted in FIG. 2*b* as an example, and can be directly compared with the curve, according to FIG. 2*a*, in the final result. Thus, this voltage curve is also variable so that for its determination a more realistic model can be used than hitherto customary.

Thus, it is possible to regard not only the oscillatory spring-mass system but the entire actuator, which comprises, as explained, the mechanical spring-mass system and the electromagnetic subsystem coupled thereto. This entire actuator represents a nonlinear system, which exhibits typical nonlinear effects, according to the theory of anharmonic oscillations (see for example L. D. Landau and E. M Lifschitz, Textbook of Theoretic Physics, Volume 1: Mechanics, Chapter V, §§ 28, 29, pp. 103–106). Thus, the resonance frequency of the entire actuator system is displaced relative to the natural frequency of the linear spring-mass oscillator. Furthermore, the location and speed curve of the oscillating element, the armature, does not have in general an exactly sinusoidal curve. Furthermore, the frequency a of oscillation is a function of the amplitude of the oscillation.

Starting from this point, it is now proposed to no longer excite an electromagnetic actuator with periodic rectangular voltage pulses and not necessarily with the natural frequency of the spring-mass system, but rather to use a suitable input signal having a periodic curve that is adapted to the nonlinear oscillating system - essentially a sinusoidal curve or the like, which is variable, for the purpose of setting up an oscillation. The amplitude or the pulse width keying ratio of the respectively chosen curve of the alternating voltage follows from the theory of anharmonic oscillations (and does not agree in general with the natural frequency of the spring-mass system).

In this respect consideration must be given that the frequency of the entire system generally depends on the amplitude of oscillation so that consequently the frequency of the alternating voltage can be varied as a function of the armature's amplitude of oscillation.

Furthermore, it was recognized that the damping of the spring-mass system, contained in the entire actuator, can be temperature-dependent, especially when the viscosity effects of a lubricating oil comes into contact with a part of the entire system are taken into account. The result is a displacement of the system resonant frequency. As a result, the electromagnetic actuator has to be set into oscillation at a different frequency or can be set into oscillation only at a different frequency when the ambient temperatures are different. Therefore, in determining the frequency of the proposed, periodic, essentially sinusoidal alternating voltage, such temperature effects can be taken into consideration. Thus, unnecessarily high energy consumption of the electromagnetic actuator is avoided. For example, during a cold start of an internal combustion engine equipped with such electromagnetic actuators, it is namely no longer necessary, as proposed in European Patent EP 0 118 591B1 to reduce the exciter frequency over an extremely long period of time until it is finally in an order of magnitude of the natural frequency, reduced due to the temperature-dependent or cold-influenced increased damping. Rather the alternating voltage with suitable frequency can be applied immediately to the electromagnet coils. In this manner a fast setting into oscillation can be achieved so that there is no unnecessarily high energy consumption.

Finally with the variable, essentially sinusoidal or similarly exciting alternating, voltage consideration can be given to other concepts. Namely, even on the basis of the linear spring-mass system it is desirable that setting up oscillation with a periodic force curve that is adapted to the oscillatory system results in excitation. The aforementioned, rectangular curve, illustrated in FIG. 3, has, in accordance with a Fourier analysis, a relatively high harmonic content so that in particular even a real actuator, as explained above, represents a highly nonlinear system. Under some circumstances undesired harmonics are excited in the actuator so that this factor also results in an unnecessarily high energy consumption. To remedy this problem, it is now proposed that the waveform or sinusoidal form of the exciting voltage be chosen in such a manner that only the fundamental oscillation, and not the harmonics of the spring-mass system, is excited.

Thus, the process of the invention is characterized in particular by low energy consumption and thus a lower demand in electric power. In an advantageous manner, lower amplitudes are sufficient for setting into oscillation the actuator. In addition, reference must also be made to the fact that, details of, for example, the actually used actuator, can deviate from the above description or from the simplified illustration of the figures without leaving the content of the patent claims.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for setting into oscillation an electromagnetic actuator, which actuates a switching element, in particular an internal combustion engine lift valve and in which process an armature, which acts on the switching element, is oscillated between two electromagnet coils against the force of at least one reset spring by means of alternating flow around the electromagnet coils whereby the switching element with the armature and the reset springs represents an oscillatory springs mass system, and wherein, starting from the quiescent state of the system, where the armature is held by the reset springs essentially in the center between these magnet coils in order to set into oscillation this spring-mass system, the electromagnet coils are excited alternatingly by driving with an electric alternating voltage of a specific frequency, including the step of applying an essentially sinusoidal alternating voltage to the electromagnet coils in the form of a constantly sinusoidal voltage curve or in the form of a correspondingly variable pulse width-modulated voltage curve.

2. The process as claimed in claim 1, wherein the frequency of the alternating voltage is different from a natural frequency of a spring-mass system formed by said armature, said reset spring and said engine lift valve.

3. The process as claimed in claim 1, wherein the frequency of the alternating voltage is varied as a function of the amplitude of oscillation of the armature.

4. The process as claimed in claim 1, wherein determining the frequency of the alternating voltage is a function of a temperature-dependent change of the damping of the spring-mass system.

5. The process according to claim 1, wherein the sinusoidal form of the alternating voltage is selected so that the fundamental oscillation, but not the harmonics of the spring-mass system, is excited.

6. An internal combustion engine lift valve system comprising:

a first and a second electromagnetic coil;

an armature positioned between said first and second magnetic coils;

at least one reset spring providing a force on said armature;

means for exciting said first and second electric magnetic coils including means for providing an essentially alternating voltage to said first and second electromagnetic coils in the form of one of a variable constant curve and a variable pulse width-modulated voltage curve, in order to move said armature between said first and said second coils to provide oscillation of a spring-mass system formed by said lift valve, said armature and said at least one reset spring.

7. The system according to claim 6, wherein the frequency of the alternating voltage is different from a natural frequency of the spring-mass system.

8. The system according to claim 6, wherein the frequency of the alternating voltage is varied as a function of an amplitude of oscillation of said armature.

9. The system according to claim 6, wherein the frequency of the alternating voltage is a function of a temperature-dependent change of the damping spring-mass system and of its resonance frequency.

10. The system according to claim 6, wherein the wave form of the alternating voltage is chosen so that only the fundamental oscillation, but not the harmonics of the spring-mass system is excited.

* * * * *